US006012904A

United States Patent [19]

Tuckey

[11] Patent Number: 6,012,904

[45] Date of Patent: Jan. 11, 2000

[54] VENTED FUEL MODULE RESERVOIR WITH TWO-STAGE PUMP

[75] Inventor: Charles H. Tuckey, Cass City, Mich.

[73] Assignee: Walbro Corporation, Cass City, Mich.

[21] Appl. No.: 08/427,653

[22] Filed: Apr. 21, 1995

Related U.S. Application Data

[63] Continuation of application No. 08/245,375, May 18, 1994, abandoned, which is a continuation-in-part of application No. 08/243,856, May 17, 1994, Pat. No. 5,427,074.

[51] Int. Cl.[7] ..... F04B 23/14

[52] U.S. Cl. ..... 417/203; 417/251; 417/435; 417/253

[58] Field of Search ..... 417/250, 251, 417/253, 306, 435, 203; 415/55.5, 55.6, 55.7, 83, 84

[56] References Cited

U.S. PATENT DOCUMENTS

| | | | |
|---|---|---|---|
| 4,569,637 | 2/1986 | Tuckey | 417/435 |
| 4,672,937 | 6/1987 | Fales et al. | 123/509 |
| 4,715,777 | 12/1987 | Tuckey | 515/53 T |
| 4,747,388 | 5/1988 | Tuckey | 123/514 |
| 4,865,522 | 9/1989 | Radermacher | 417/203 |
| 5,050,567 | 9/1991 | Suzuki | 123/514 |
| 5,110,265 | 5/1992 | Kato et al. | 417/279 |
| 5,146,901 | 9/1992 | Jones | 123/516 |
| 5,257,916 | 11/1993 | Tuckey | 417/423 |
| 5,263,459 | 11/1993 | Talaski | 417/435 |
| 5,265,997 | 11/1993 | Tuckey | 415/55.1 |

FOREIGN PATENT DOCUMENTS

| | | | |
|---|---|---|---|
| 0160545 | 9/1983 | Japan | 417/435 |

OTHER PUBLICATIONS

Pierburg Publication, 1989.

*Primary Examiner*—Charles G. Freay

*Attorney, Agent, or Firm*—Reising, Ethington, Barnes, Kisselle, Learman & McCulloch, P.C.

[57] ABSTRACT

A main fuel tank in an automotive vehicle contains a reservoir in which is located a two-stage electrically operated pump. The first stage is a rotary side lateral pump which draws fuel from the main tank and delivers it to the reservoir. The second stage is a rotary turbine pump which draws fuel from the reservoir and delivers it to the vehicle engine. The reservoir has overflow restriction means which allows air to vent while the reservoir is filling with fuel but which restricts fuel flow when the reservoir is full. This creates pressure in the reservoir to create back pressure against and shut down fuel flow from the first stage pump and also increase pressure on the fuel inlet of the second stage pump thus increasing the efficiency of the second stage fuel pump.

15 Claims, 2 Drawing Sheets

VENTED FUEL MODULE RESERVOIR WITH TWO-STAGE PUMP

This is a continuation of application Ser. No. 08/245,375 filed on May 18, 1994, now abandoned, which is a continuation-in-part of U.S. patent application Ser. No. 08/243,856, filed May 17, 1994, now U.S. Pat. No. 5,427,074.

FIELD OF THE INVENTION

This invention relates to an automotive vehicle fuel system, and more particularly a fuel pump module with a reservoir receivable in a vehicle fuel tank.

BACKGROUND OF THE INVENTION

In vehicle fuel systems, an electrically driven fuel pump is mounted in a fuel reservoir which, in turn, is located in the main vehicle fuel tank. The pump has an outlet leading to a fuel rail which distributes operating fuel to fuel injection units in a fuel rail at the engine. In some fuel systems, the pump has a capacity greater than that required by the engine and a pressure relief valve discharges over-capacity fuel to a return line which dumps into the reservoir.

Some systems have provided for over flow of fuel from the reservoir to the main tank. However, the reservoir fuel may be hot due to the return flow and it is not desirable that hot fuel reach the main tank. Also, it is desirable that the reservoir be closed at the top to create a back pressure and accordingly increase the pressure at the main fuel inlet to provide a force feed to the main pump.

Two-stage pumps are known and the present invention contemplates the use of a two-stage power driven pump in connecting with a fuel reservoir. A turbine vane pump is disclosed in U.S. Pat. No. 5,265,997 (Nov. 30, 1993) and also in U.S. Pat. No. 5,257,916 (Nov. 2, 1992) issued to C. H. Tuckey and the assignee common to this application. A two-stage pump is described in a German patent to Volkswagenwerk, No. 3532349 dated Mar. 27, 1986, and a Pierburg publication illustrates a two-stage pump utilizing two separate axially spaced rotors: a first rotor to deliver fuel from a main fuel tank to a reservoir, and a second rotor to deliver fuel from a reservoir to a main pump outlet.

SUMMARY OF THE INVENTION

A main fuel tank in an automotive vehicle contains a reservoir holding an electrically operated pump. The pump utilizes two-stage turbine rotor, the first stage drawing fuel from the base of a main fuel tank and delivering to the reservoir. The second main stage of the rotor draws fuel from the reservoir and delivers it to the engine through a main pump outlet. In the present invention, the reservoir is selectively closed to overflow by either a calibrated vent at the top or a float valve, which will close when the fuel level in the reservoir reaches the top of the reservoir. This closure will cause pressure from the first stage pump to increase in the reservoir and essentially shut down the first stage pump out flow. The increased pressure in the reservoir will act on fuel entering the main pump inlet from the reservoir and force feed fuel into the pump, thereby increasing the efficiency of the system. Preferably a fuel return passage from the fuel system dumps returned fuel into the reservoir.

Another feature of the invention lies in the fact that hot fuel returning to the reservoir will not heat the fuel in the main tank. Still another feature is the reduction in fuel flow through the primary filter at the base of the reservoir.

It is therefore an object of the invention to provide a top closure in a fuel tank reservoir which will prevent overflow of hot fuel into a main tank. Another object is a scheduled closure of the reservoir dependent on fuel level to develop back pressure against a primary pump outlet thereby stemming flow into the reservoir and effecting a pressure build-up to increase fuel inlet flow to the main pump inlet.

BRIEF DESCRIPTION OF THE DRAWINGS

These and other objects, features and advantages of this invention with be apparent from the following detailed description of the preferred embodiments and best mode, appended claims and accompanying drawings in which:

DETAILED DESCRIPTION

Figure 1:
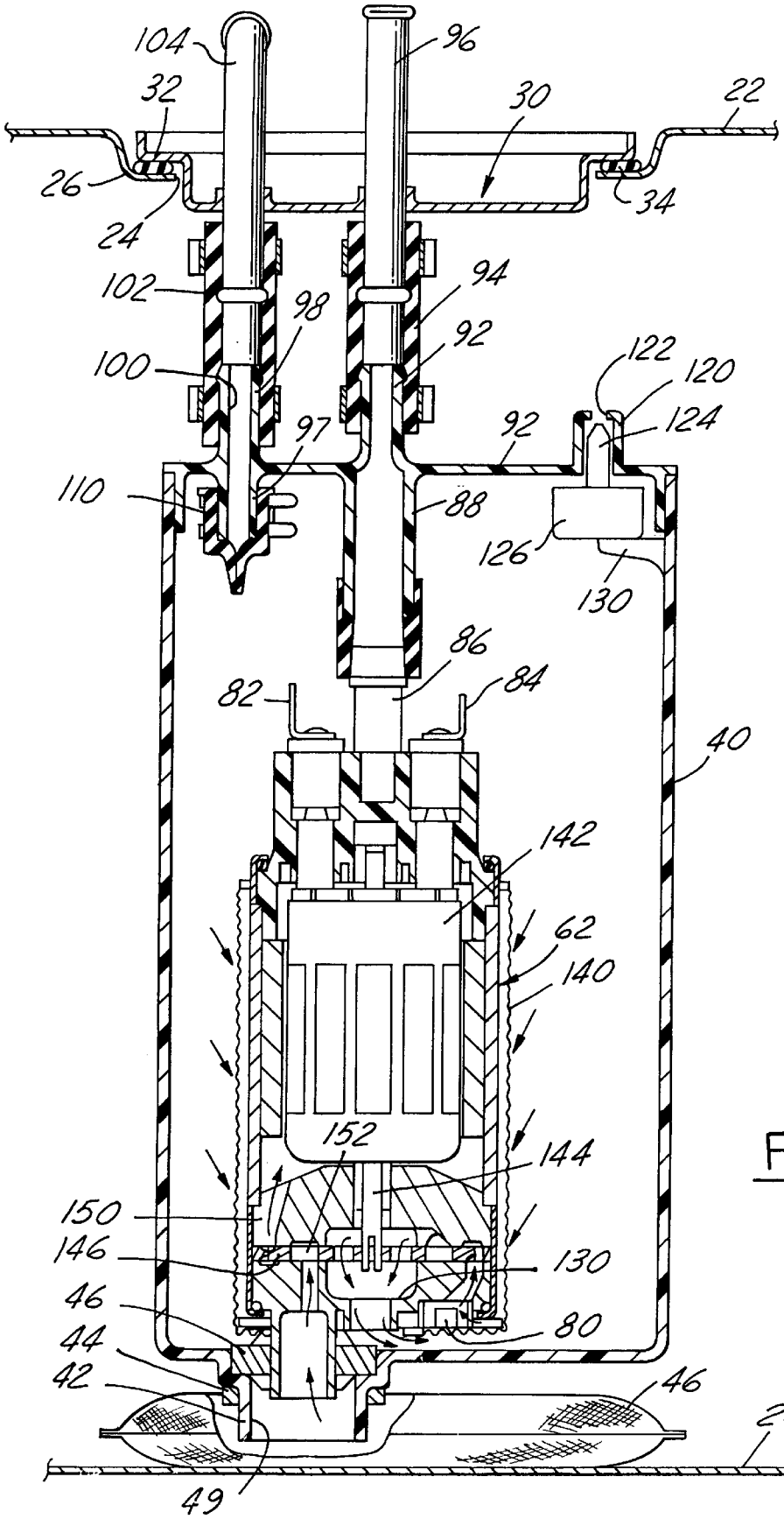
FIG. 1 is a sectional view of an in-tank reservoir with the included fuel pump.

In FIG. 1 of the drawings, the main fuel tank of a vehicle is exemplified by a bottom wall 20 and a top wall 22, the top wall having an opening 24 defined by a depressed annular flange 26. A sealing closure cover 30 has a peripheral flange 32 resting on a sealing ring 34.

An in-tank fuel reservoir 40 has a narrowed lower end terminating in a boss 42 which is received in a collar 44 at the top of a sock filter 46 resting on the tank bottom 20. An opening in boss 42 provides a fuel inlet 49 open to the sock filter and the base of the main fuel tank. Resting on a shoulder in boss 42 is a sealing collar 46 which receives a tubular inlet 48 formed in the base of an electrically driven pump 62 within the reservoir 40. The pump 62 may be an electrically powered turbine pump as described in a U.S. Pat. No. 5,257,916 (Nov. 2, 1993) to C. H. Tuckey but is modified to become a two-stage pump.

Figure 3:
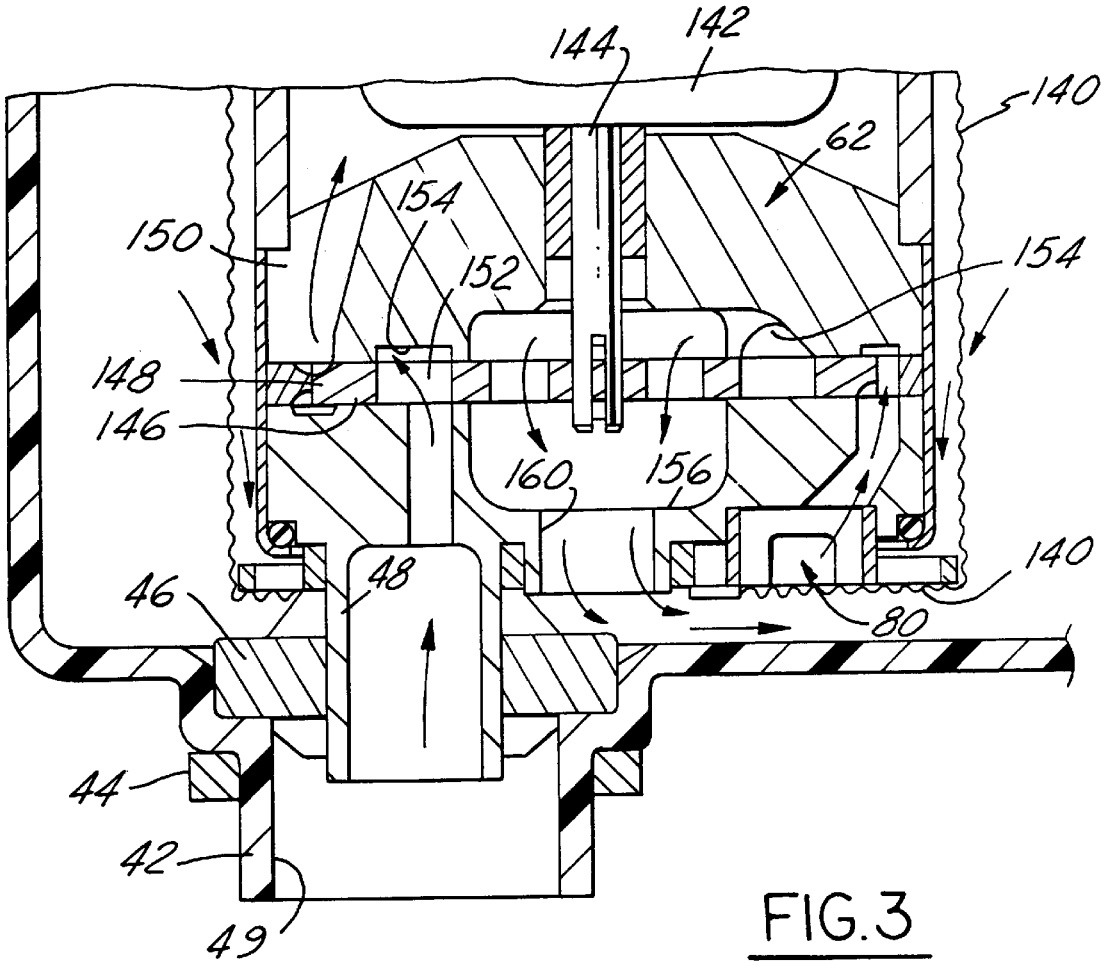
FIG. 3 is an enlarged sectional view of the lower end of a reservoir showing the two-stage turbine pump.

With reference to FIGS. 1 and 3, a main pump fuel inlet is illustrated at 80 open to fuel in the reservoir 40.

Turning now to the top of the pump and reservoir, the pump has electrical connections 82 and 84, and a pump outlet tube 86 has a sealed relationship to a hollow outlet conduit 88 depending from a top cover plate 90 on reservoir 40. A conventional wiring system (not shown) initiates operation of the pump when the vehicle ignition system is turned on. Conduit 88 terminates above cover plate 90 in a nipple connection 92 which is attached by a flexible coupling 94 to a fuel passage 96 projecting through the cover 30 and leading to a vehicle engine (not shown).

The top cover plate 90 has also a depending passage 97 and an upstanding passage 98 forming a through passage 100. A flexible coupling 102 connects passage 100 to a system conduit 104 which passes through cover 30. The system conduit 104 is a fuel return passage in a fuel system in which fuel under pressure from the pump delivers fuel to an engine but a pressure regulator valve in the outlet line by-passes fuel above a predetermined pressure back to the reservoir. This is described in U.S. Pat. No. 4,747,388 (May 31, 1988) issued to C. H. Tuckey. At the end of the depending passage 97 is clamped a one-way duck bill valve 110 which admits return fuel to the interior of the reservoir but blocks any outward flow.

It will be appreciated that, if fuel is to enter the reservoir, there must be a means of venting air above the fuel. In FIG. 1, an upstanding valve chamber 120 is provided with a valve seat opening 122. A valve stem 124 has a loose fit in the chamber 120 and is supported on a float block 126, which is retained in a lowest position by a short shelf 130. Accordingly, when the reservoir is filling, air can escape around the valve stem 124. When the liquid level reaches the top, the float will raise the valve stem so that the tapered end will close the valve opening 122 and pressure will build up in the reservoir.

Figure 2:
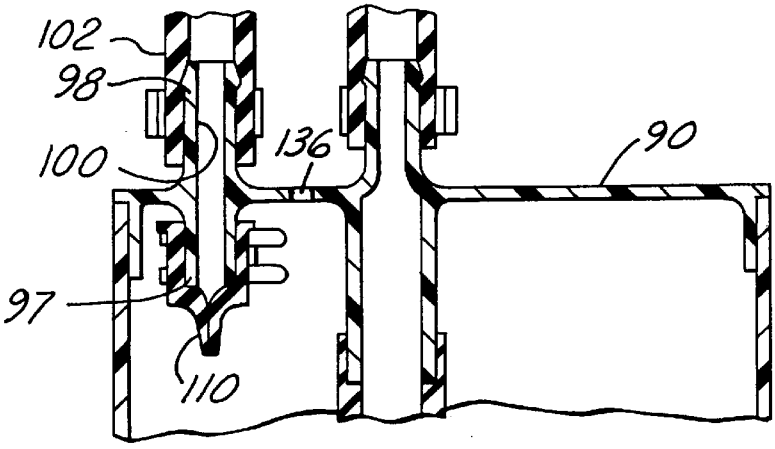
FIG. 2 is a fragmental view of the top of the reservoir with an optional control vent.

In FIG. 2, a vent is illustrated in the form of a calibrated port 136. This port will vent air from the reservoir while it is filling. When liquid reaches the port it will not pass readily through the port and pressure will build up in the reservoir.

The pump 62 has a suitable housing surrounded by a filter 140 which also covers the inlet 80. An armature 142 has a drive shaft 144 which drives a rotor 146 with peripheral turbine vanes 148 which rotate in a pumping channel as described in above referenced U.S. Pat. Nos. 5,257,916 and 5,265,997. The pump inlet 80 feeds fuel from the reservoir 40 and the pump delivers the main fuel discharge to a passage 150 and thence to the armature chamber and outlet 86, 88, 94, 96.

Radially inward of the perimeter vanes 148 is a series of vanes 152 which revolve around an annular lateral channel 154 (FIG. 3). This lateral channel pump draws fuel from the main tank and filter 46 through inlet 48, and delivers it to an outlet chamber 156 and an outlet passage 160 leading to the interior of the reservoir 40. A lateral channel pump, illustrated in FIGS. 1 and 3, is shown and described in U.S. Pat. No. 4,715,777 issued Dec. 27, 1982 to C. H. Tuckey. Thus, the first stage lateral channel pump 152 delivers fuel to the reservoir 40 directly from the main tank, while the second stage turbine vane pump delivers fuel from reservoir 40 to outlet 86.

Operation

When the pump 62 is started such as by the closing of the ignition switch of the vehicle, the first stage lateral channel pump 152 will draw fuel from the main fuel tank through inlet 48 and deliver it to the reservoir 40. At the same time, the second stage pump 146 will draw fuel through filter 140 and inlet 80 and deliver to the main pump outlet 86,96.

The reservoir will be receiving fuel, and air and vapor will be vented through port 122 until the fuel level reaches the float 126 illustrated in FIG. 1. The lifting of the float will cause the valve stem 124 to close the port 122. This will cause pressure in the reservoir to build up and create back pressure at the outlet of the lateral channel pump, thus effectively stopping the entrance of fuel into the reservoir. This back pressure in the reservoir will cause a force feed of fuel from the reservoir into the main pump inlet 80 and thus increase the efficiency of the main pump delivering fuel to a vehicle engine.

In FIG. 2, the valve 124, shown in FIG. 1, is eliminated and the calibrated vent 136 allows air to escape as the reservoir fills. When fuel reaches the vent 136, the additional viscosity of the fuel slows any significant escape of fuel through the vent and pressure builds up in the reservoir to create back pressure in the reservoir and a consequent reduction of fuel exiting the lateral channel pump. Again, this pressure build up will increase pressure on fuel entering the main pump inlet and increase the efficiency of the main fuel pump.

The fuel return passage 104 will direct excess fuel at a low pressure from a pressure regulator (not shown) into the reservoir through a duck bill valve 110 which is a one-way valve into the reservoir.

The two-stage turbine pump arrangement has an advantage in that the lateral channel pump 152 will draw fuel from the main fuel tank even under conditions of low fuel level as, for example, when the tank has gone dry and a gallon or so of fuel has been added. This will also be true under start-up conditions when there is a low voltage available to drive the pumps. Another advantage of the system derives from the fact that any vapor which results from the agitation in the lateral channel pump will enter the reservoir and become condensed to liquid in the reservoir and thus will not enter the inlet to the main fuel pump. Since, in contrast to the use of a jet pump, which must derive its driving source from the outlet of the main pump, there is no diversion of fuel from the main pump outlet, a more effective pumping of fuel to the engine results. This is especially true when pressure in the closed reservoir force feeds the fuel at the inlet 80 of the main turbine pump.

What is claimed is:

1. A fuel delivery system for an automotive vehicle which comprises:

(a) a main fuel tank in said vehicle, (b) a closed reservoir in said main fuel tank, a single electric pump drive in said reservoir, (c) a first rotary pump in said reservoir having a plurality of first vanes, a first inlet communicating with said first vanes for drawing fuel from immediately adjacent the bottom of said main tank and a first outlet communicating with said first vanes for delivering fuel into said reservoir through said first outlet, when operating the fuel delivered from the first outlet into the reservoir by the first pump being responsive to and reduced by increasing pressure within the reservoir, (d) a second rotary pump in said reservoir having a plurality of second vanes, a second inlet independent of said first inlet, open to the interior of said reservoir immediately adjacent the bottom of the reservoir, and communicating with said second vanes for drawing fuel from said reservoir, and a second outlet communicating with said second vanes to deliver fuel to an engine, (e) both said plurality of first vanes of said first rotary pump and said plurality of second vanes of said second rotary pump being simultaneously driven by said single electric pump drive, and (f) a vent carried by the reservoir for venting air and fuel vapor from adjacent the top of the reservoir as fuel rises in said reservoir, said vent also being responsive to a first fuel level adjacent the top of said reservoir to effectively close said vent to allow pressure to be built up in said reservoir by said pumps when they are running to reduce the delivery of fuel into the reservoir by the first pump, and said vent being responsive to a second fuel level in said reservoir below said first fuel level to open and vent air and vapor from the reservoir to relieve the pressure in the reservoir both when the pumps are running and are not running.

2. A fuel delivery system for an automotive vehicle which comprises:

(a) a main fuel tank in said vehicle, (b) a closed reservoir in said main fuel tank, an electric pump drive in said reservoir, (c) a first rotary pump in said reservoir having a plurality of first vanes, a first inlet communicating with said first vanes for drawing fuel from said main tank and a first outlet communicating with said first vanes for delivering fuel into said reservoir through said first outlet, when operating the fuel delivered from the first outlet into the reservoir by the first pump being responsive to and reduced by increasing pressure within the reservoir, (d) a second rotary pump in said reservoir having a plurality of second vanes, a second inlet independent of said first inlet, open to the interior of said reservoir and communicating with said second vanes for drawing fuel from said reservoir, and a second outlet communicating with said second vanes to deliver fuel to an engine, (e) both said first and second rotary pumps being driven by said electric pump drive, and (f) a vent carried by the reservoir for venting air and fuel vapor from adjacent the top of the reservoir as the fuel rises in said reservoir, said vent also being responsive to a fuel level adjacent the top of said reservoir to effectively close said vent to allow pressure to build up in said reservoir when said pumps are running to reduce the delivery of fuel into the reservoir by the first pump, and said first and second rotary pumps are formed on a single rotor and are driven simultaneously by said electric pump drive.

3. A fuel delivery system as defined in claim 2 in which said first rotary pump is a lateral channel pump in cooperation with a vaned rotor.

4. A fuel delivery system for an automotive vehicle which comprises:

(a) a main fuel tank in said vehicle, (b) a closed reservoir in said main fuel tank, an electric pump drive in said reservoir, (c) a first rotary pump in said reservoir having a first inlet for drawing fuel from said main tank and a first outlet for delivering fuel to said reservoir through said first outlet, (d) a second rotary pump in said reservoir for drawing fuel from a second inlet independent of said first inlet and open to the interior of said reservoir and having a main pump second outlet to deliver fuel to an engine, and (e) a vent for venting air and fuel vapors from adjacent the top of the reservoir as fuel rises in said reservoir, said vent also being responsive to a fuel level adjacent the top of said reservoir to effectively close said vent to allow a pressure to build up in said reservoir when said pumps are running, said first and second rotary pumps are formed on a single pump rotor and are driven simultaneously by said electric pump drive, said first rotary pump is a side lateral channel pump in cooperation with a vaned rotor, and said second rotary pump is a turbine type rotary pump.

5. A fuel delivery system as defined in claim 4 in which said vent comprises a valve opening, and a float valve positioned to cooperate with said opening to close said opening in response to the fuel level being adjacent the top of said reservoir.

6. A fuel delivery system as defined in claim 4 in which said vent comprises a calibrated vent opening adjacent the top of said reservoir which readily vents air and vapor from said reservoir but in response to the presence of liquid fuel effectively causes pressure to build up in said reservoir when said pumps are running.

7. A fuel delivery system as defined in claim 4 which also comprises a fuel return passage opening into the interior of said reservoir for returning fuel from the engine to the interior of said reservoir, and a valve associated with said return passage to prevent reverse flow of fluid from the interior of said reservoir through said return passage.

8. A fuel delivery system for an automotive vehicle which comprises: a closed reservoir constructed to be received in a main fuel tank for a vehicle, an electric motor received in said reservoir, a single pump rotor driven by the electric motor and having first vanes thereon for a first pump and second vanes thereon for a second pump, said first pump being in said reservoir and having a first inlet communicating with said first vanes and opening to the exterior of said reservoir for communicating with the fuel tank, and a first outlet communicating with said first vanes and opening into the interior of said reservoir for delivering fuel from the main tank to the interior of the reservoir, when operating the fuel delivered from the first outlet into the reservoir by the first pump being responsive to and reduced by increasing pressure within the reservoir, said second pump being in said reservoir and having a second inlet communicating with said second vanes and open to the interior of said reservoir and independent of both said first inlet and said first outlet and a second outlet communicating with said second vanes and opening to the exterior of said reservoir for supplying fuel from the interior of said reservoir to a vehicle engine, a vent carried by said reservoir for venting gas and fuel vapor from the interior of said reservoir as the level of liquid fuel in said reservoir rises and for effectively retarding or stopping the venting of gas and fuel vapor when the fuel level in said reservoir rises to adjacent the top of said reservoir to thereby allow fuel pressure in said reservoir to increase due to the operation of said pumps to reduce the delivery of fuel into the reservoir by the first pump.

9. A fuel delivery system as defined in claim 7 in which said first vanes of said first pump cooperate with at least one lateral side channel.

10. A fuel delivery system as defined in claim 7 in which said second vanes of said second pump are adjacent the periphery of said single pump rotor and cooperate with a pumping channel to supply fuel to said second outlet.

11. A fuel delivery system as defined in claim 7 in which said first vanes cooperate with at least one lateral side channel to deliver fuel from said first inlet to said first outlet and said second vanes are adjacent the periphery of said pump rotor and cooperate with a second pump channel to supply fuel from said reservoir through said second inlet to said second outlet.

12. A fuel delivery system as defined in claim 8 wherein said vent comprises a valve movable to an open position to permit gas and fuel vapor to pass to the exterior of said reservoir and to a closed position to seal the vent in response to the level of liquid fuel within said reservoir rising to adjacent the top of said reservoir.

13. A fuel delivery system as defined in claim 8 in which said vent comprises a valve seat communicating with the exterior of said container, a valve sealingly engagable with said seat and movable to open and closed positions relative to said seat, and a float connected to said valve and constructed to move said valve to its closed position in response to the level of liquid fuel within said reservoir rising to adjacent the top of said reservoir.

14. A fuel delivery system as defined in claim 8 in which said vent comprises a port communicating with both the interior and the exterior of said reservoir and sized to permit gas and fuel vapor to flow from said reservoir as the level of fuel rises until liquid fuel contacts said port whereupon substantially no air and fuel vapor will pass through said port and the quantity of any liquid fuel passing through said port will be sufficiently small so that the pressure of liquid in the reservoir will build up due to operation of said pumps.

15. A fuel delivery system as defined in claim 8 which also comprises a fuel return passage opening into the interior of said reservoir for returning fuel from the engine to the interior of said reservoir, and a valve associated with said return passage to prevent reverse flow of fluid from the interior of said reservoir through said return passage.

* * * * *

UNITED STATES PATENT AND TRADEMARK OFFICE

CERTIFICATE OF CORRECTION

PATENT NO. : 6,012,904
DATED : January 11, 2000
INVENTOR(S) : Charles H. Tuckey

It is certified that error appears in the above-identified patent and that said Letters Patent is hereby corrected as shown below:

Column 6,
Line 25, change "claim 7" to -- claim 8 --.
Line 28, change "claim 7" to -- claim 8 --.
Line 32, change "claim 7" to -- claim 8 --.

Signed and Sealed this

First Day of January, 2002

*Attest:*

*Attesting Officer*

JAMES E. ROGAN
*Director of the United States Patent and Trademark Office*